US006564421B2

(12) United States Patent
Park et al.

(10) Patent No.: US 6,564,421 B2
(45) Date of Patent: May 20, 2003

(54) MULTI FUNCTIONAL CLEANING MODULE OF MANUFACTURING APPARATUS FOR FLAT PANEL DISPLAY AND CLEANING APPARATUS USING THE SAME

(76) Inventors: Yong Seok Park, 303-1105, Garakssangyong Apt., Garak-dong, Songpa-ku, Seoul-shi (KR); Jum Lyul Han, 105-1505, Donga Apt., Won-dong, Osan-shi, Kyungki-do (KR); Jeong Jin Kim, 106-1505, Hangdangdaelim Apt., Hangdang-dong, Sundong-ku, Seoul-shi (KR); Byeong Hoo Park, 402, Daedong Apt., limeun-dong, Gumi-shi, kyungsangbuk-do (KR)

( * ) Notice: Subject to any disclaimer, the term of this patent is extended or adjusted under 35 U.S.C. 154(b) by 0 days.

(21) Appl. No.: 09/894,625

(22) Filed: Jun. 28, 2001

(65) Prior Publication Data

US 2002/0000019 A1 Jan. 3, 2002

(30) Foreign Application Priority Data

| | | |
|---|---|---|
| Jun. 29, 2000 | (KR) | 2000-36458 |
| Mar. 20, 2001 | (KR) | 2001-14321 |
| Jun. 7, 2001 | (KR) | 2001-31664 |
| Jun. 7, 2001 | (KR) | 2001-31665 |
| Jun. 7, 2001 | (KR) | 2001-31674 |

(51) Int. Cl.[7] ..... B08B 1/02; B08B 3/02; B08B 7/00

(52) U.S. Cl. ..... 15/302; 15/308; 15/309.1

(58) Field of Search ..... 15/302, 308, 309.1, 15/309.2

(56) References Cited

U.S. PATENT DOCUMENTS

| | | | | |
|---|---|---|---|---|
| 4,454,621 A | * | 6/1984 | Testone | 15/1.51 |
| 5,564,159 A | * | 10/1996 | Treiber | 134/109 |
| 5,968,037 A | * | 10/1999 | Rizoiu et al. | 606/10 |
| 6,272,768 B1 | * | 8/2001 | Danese | 34/202 |
| 6,272,886 B1 | * | 8/2001 | Novack et al. | 430/290 |

* cited by examiner

*Primary Examiner*—Chris K. Moore
(74) *Attorney, Agent, or Firm*—Greenberg Traurig; Eugene C. Rzucidlo; Richard E. Kurtz, II

(57) ABSTRACT

The multi functional cleaning module comprises a plurality of air curtain, an eximer ultraviolet light irradiating device, a brush, a high-speed shower device, and an air knife, where they are arranged continually on a plan and the glass substrates are inserted continually into them. The cleaning apparatus using the multi functional cleaning module comprises a driving part having a loading and an unloading portions as well as the multi functional cleaning module.

10 Claims, 17 Drawing Sheets

MULTI FUNCTIONAL CLEANING MODULE OF MANUFACTURING APPARATUS FOR FLAT PANEL DISPLAY AND CLEANING APPARATUS USING THE SAME

BACKGROUND OF THE INVENTION

1. Field of the Invention

The present invention relates to a manufacturing apparatus for a flat panel display, and more particularly to a multi functional cleaning module, which the elements are integrated thereby minimizing an installation area, and a cleaning apparatus using the multi functional cleaning module.

2. Description of the Related Art

FIG. 1*a* is a block diagram showing a conventional cleaning apparatus of a manufacturing apparatus for the flat panel display, and FIG. 1*b* is a schematic constitution diagram.

Referring to FIG. 1*a* and FIG. 1*b,* the conventional cleaning apparatus comprises a transport part having a loading portion and an unloading portion, a cleaning part having a $O_3$ treating portion, a brushing portion, a jet portion, and a D.I. (de ionized water) shower portion, and a drying part.

The loading portion of the transport part bring a glass substrate (not illustrated) in the cleaning apparatus, and the unloading portion of the transport part bring the glass substrate out the cleaning apparatus.

The cleaning part removes a pollutant and impurity on the glass substrate.

The drying part dries a cleaner such as D.I remained on the glass substrate after cleaning process.

In the above processes, the glass substrate is moved by an under bearing.

However, in the conventional cleaning apparatus, it is difficult to continually progress the manufacturing processes including the cleaning in connection with another manufacturing process except for cleaning process because the installation area is too large, and thereby decreasing a FAB efficiency.

SUMMARY OF THE INVENTION

Accordingly, the present invention is directed to a that substantially obviates one or more problems due to limitations and disadvantages of the related art.

An object of the present invention is to provide a multi functional cleaning module, which the elements are integrated thereby minimizing an installation area and operating effectively a space in FAB.

Another object of the present invention is to increase an yield of the flat panel display by using the multi functional cleaning module.

Still another object of the present invention is to provide new elements of the multi functional cleaning module.

To achieve the objects and in accordance with the purpose of the invention, as embodied and broadly described herein, the invention comprises a plurality of air curtain, an eximer ultraviolet light irradiating device, a brush, a high-speed shower device, and an air knife, where they are arranged continually on a plan and the glass substrates are inserted continually into them.

Furthermore, the cleaning apparatus according to the present invention comprises a driving part having a loading and an unloading portions as well as the multi functional cleaning module.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Hereinafter, the multi functional cleaning module and a cleaning apparatus using the same of the present invention are explained in detail by accompanying the drawings.

Figure 1A:
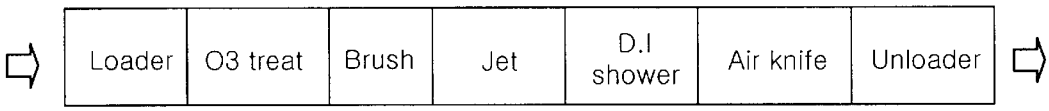
FIG.1a Prior art
FIG. 1*a* is a block diagram showing a conventional cleaning apparatus of a manufacturing apparatus for the flat panel display.
Figure 1B:
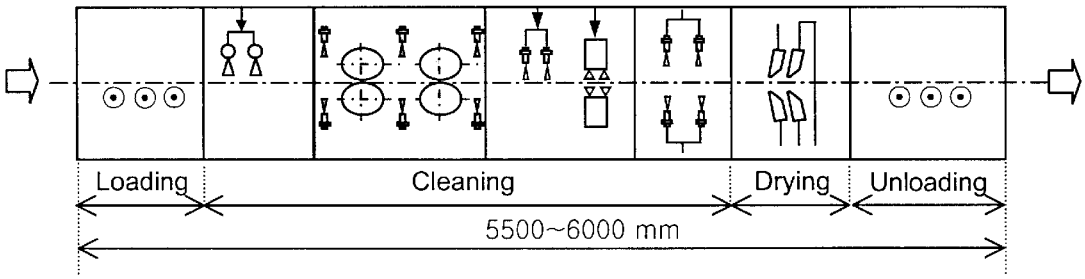
FIG.1b Prior art
FIG. 1*b* is a schematic constitution diagram.
Figure 2:
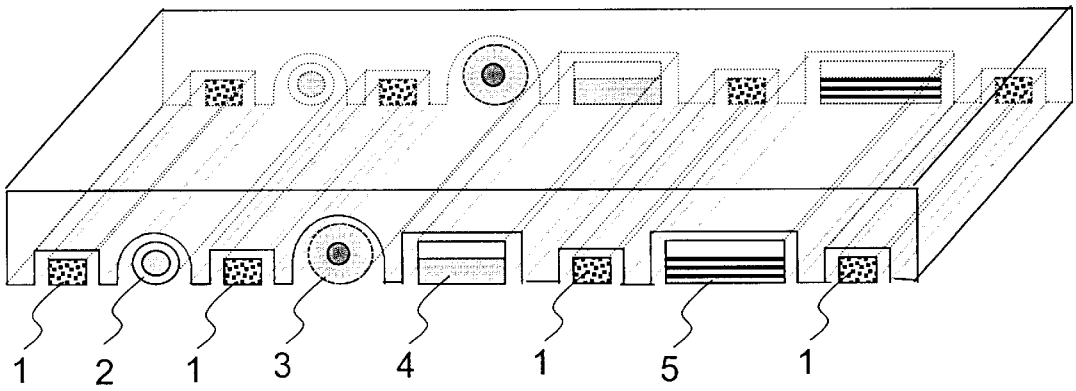
FIG. 2 is a schematic perspective view showing the multi functional cleaning module according to the present invention.

FIG. 2 is a schematic perspective view showing the multi functional cleaning module according to the present invention.

The multi functional cleaning module according to the present invention comprises a plurality of air curtains 1, an eximer ultraviolet light irradiating device 2, a brush 3, high-speed shower device 4, and an air knife 5, where they are arranged continually on a plane and the glass substrates are inserted continually into them.

The plurality of air curtains 1 are provided to exclude an interference which may be generated between them.

On the other hand, in the inventive multi functional cleaning module, each elements including the air knife are improved in comparison with the conventional cleaning module and various cleaning functions are applied to one glass substrate at the same time.

Referring to FIG. 2, the inventive multi functional cleaning module have the constitution of air curtain—eximer ultraviolet light irradiating device—brush—high-speed shower device—air curtain—air knife—air curtain. Further, according to the present invention, it is possible to provide various constitutions corresponding to functions and objects as follows.

1) air curtain—brush—high-speed shower device—air curtain—air knife—air curtain—eximer ultraviolet light irradiating device—air curtain
2) air curtain—eximer ultraviolet light irradiating device—air curtain—brush—high-speed shower device—air curtain—air knife—air curtain—eximer ultraviolet light irradiating device—air curtain
3) air curtain—eximer ultraviolet light irradiating device—air curtain—high-speed shower device—air curtain—air knife—air curtain
4) air curtain—high-speed shower device—air curtain—air knife—air curtain—eximer ultraviolet light irradiating device—air curtain
5) air curtain—eximer ultraviolet light irradiating device—air curtain—high-speed shower device—air curtain—air knife—air curtain—eximer ultraviolet light irradiating device—air curtain In another aspect according to the present invention, another constitution executing specific function may be applied except for the above constitutions 1) to 5).

For example, the high-speed shower device can be used as an etching device or a developing device. Namely, in the above aspect, the high-speed shower device jets D.I. In case of using as the etching or developing devices, the high-speed shower device jet an etchant or a developer.

Hereinafter, elements of the multi functional cleaning module according to the present invention are explained in detail by accompanying the drawings.

Eximer Ultraviolet Light Irradiating Device

Figure 3A:
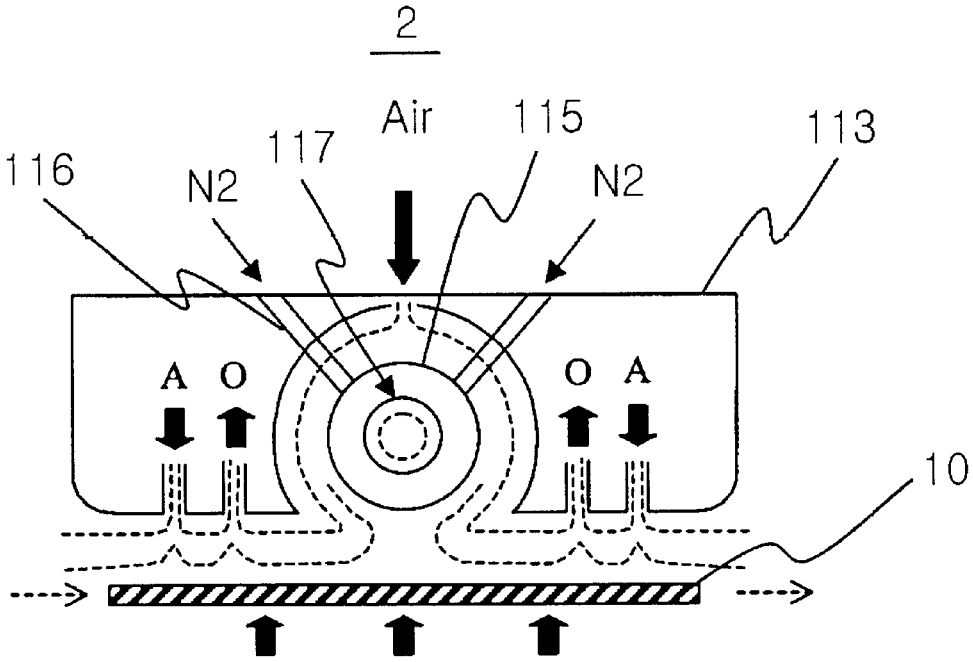
FIG. 3*a* is a schematic view showing an eximer ultraviolet light irradiating device of the multi functional cleaning module according to the present invention.

FIG. 3*a* is a schematic view showing an eximer ultraviolet light irradiating device of the multi functional cleaning module according to the present invention.

Referring to FIG. 3*a,* the eximer ultraviolet light irradiating device 2 comprises a lamp housing 113, a cylinder type quartz tube 115, and an ultraviolet light lamp 117 in the cylinder type quartz tube 115.

The eximer ultraviolet light irradiating device 2 is constituted to repress an outflow of $O_3$ gas generated by the ultraviolet light lamp 117 and to maintain a constant concentration of $O_3$, preferably 50–500 ppm, as an inflow hole→an air or $N_2$ gas pouring hole→an outflow hole→the lamp housing→the outflow hole→the air or $N_2$ gas pouring hole→the outflow hole.

In the drawing, a mark 116 represents a $N_2$ gas pouring hole, an arrow A represents an air pouring direction, and an arrow O represents an air outflow direction. On the other hand, an arrow under the glass substrate 10 represents a rising fluid outflow direction.

Figure 3B:
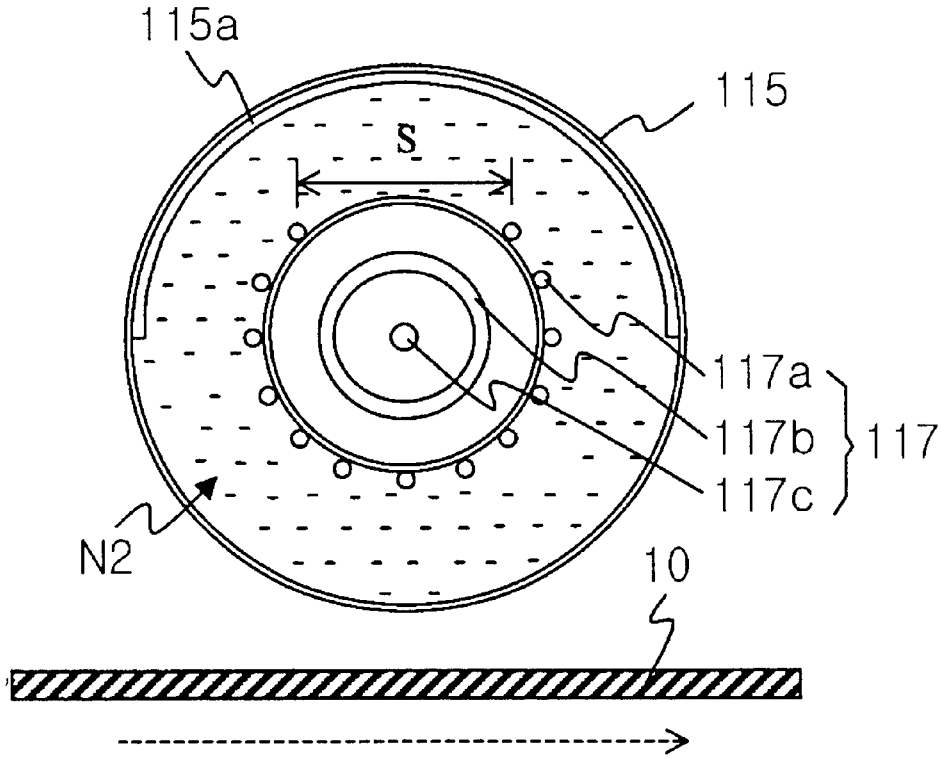
FIG. 3*b* is a sectional view of FIG. 3*a,* and FIG. 3*c* is a side view of FIG. 3*b.*
Figure 3C:
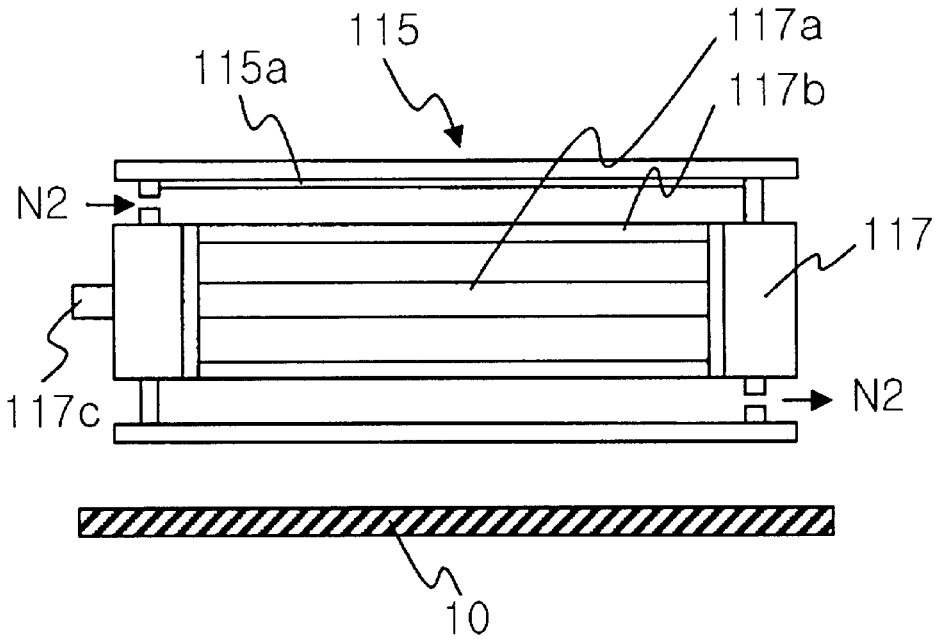

FIG. 3*b* is a sectional view FIG. 3*a,* and FIG. 3*c* is a side view.

Referring to FIG. 3*a* and FIG. 3*b,* the cylinder type quartz tube 115 have the ultraviolet light lamp 117 provided and a reflective film 115*a*. By this constitution, a light from the ultraviolet light lamp 117 is concentrated to the glass substrate 10 thereby increasing a light efficiency. At this time, the reflective film 115*a* can be made by depositing a material having a light reflective characteristic.

$N_2$ gas through the $N_2$ gas pouring hole maintains a space between the cylinder type quartz tube 115 and the ultraviolet light lamp 117 under $N_2$ gas atmosphere thereby minimizing a loss of ultraviolet light by oxygen.

The ultraviolet light lamp 117 comprises a plurality of outer electrodes 117*a,* an inner electrode 117*b,* and a lamp electric source 117*c.*

In the drawing, the outer electrodes 117*a* are provided except for a region S thereby increasing light efficiency.

Hereinafter, ultraviolet light irradiating process is explained in detail by accompanying the drawings.

Firstly, the glass substrate 10 is inserted into the apparatus by a transport device (not illustrated) and maintains in state of floating by a jet valve mentioned later. At this time, a gap between the glass substrate 10 and the lamp hosing 113 is properly maintained by controlling an intensity of the rising fluid from the jet valve.

Secondly, air is inserted into the lamp hosing 113 and $N_2$ gas is poured into the cylinder type quartz tube 115 through the $N_2$ gas pouring hole. After that, the lamp electric source 117*c* is turned on and then an electric field between the outer electrodes 117*a* and the inner electrode 117*b* is generated thereby generating ultraviolet light. At this time, in order to increase the radiation efficiency, a frequency of the lamp electric source 117*c* is preferably 20 KHz–200 KHz which is similar to a metastable state of inner gases of the lamp electric source 117*c* such as Xe, Kr, or Rn.

Some of ultraviolet light generated from the ultraviolet light lamp 117 is irradiated onto the surface of the glass substrate 10 through the cylinder type quartz tube 115, and the others of ultraviolet light are reflected by the reflective film 115*a* and then ultraviolet light is irradiated onto the surface of the glass substrate 10.

High-Speed Shower Device

Figure 4A:
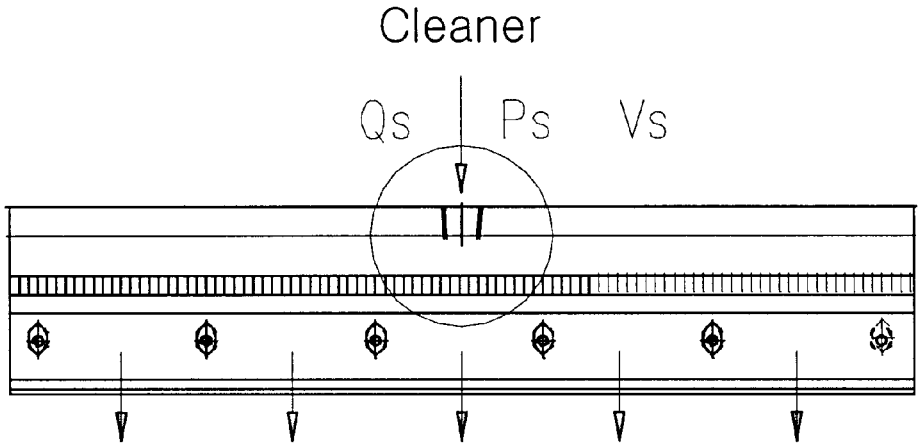
FIG. 4*a* is a drawing showing a high-speed shower device of the multi functional cleaning module according to the present invention.
Figure 4B:
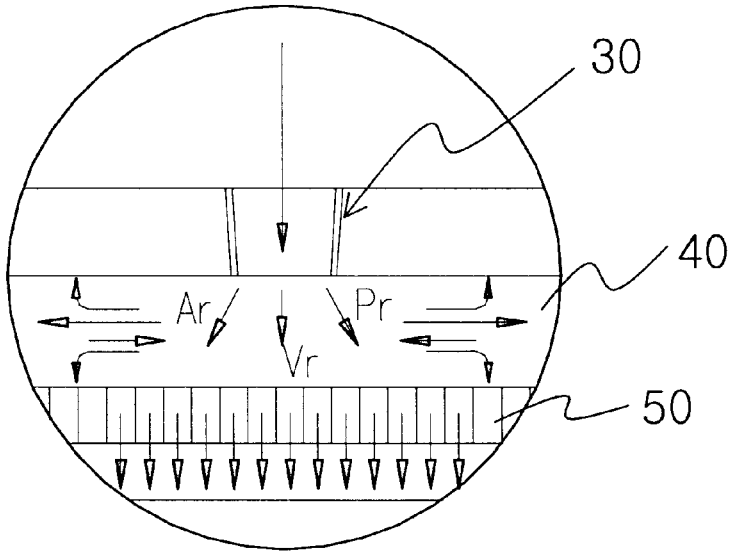
FIG. 4*b* is a partial enlarge view of FIG. 4*a.*

FIG. 4*a* is a drawing showing the high-speed shower device of the multi functional cleaning module according to the present invention, and FIG. 4*b* is a partial enlarge view of FIG. 4*a*.

Referring to FIGS. 4*a* and 4*b,* firstly, a cleaner is provided through an inflow hole 30 having a small area in state of a quantity of the cleaner is Qs and a press is Ps. After that, a speed of the cleaner flowed out from the inflow hole 30 is changed to low-speed from high-speed in a water tank 40. Further, the cleaner through a perforated plate 50 is changed a laminar flow and spread onto the surface of the glass substrate (not illustrated).

Figure 5A:
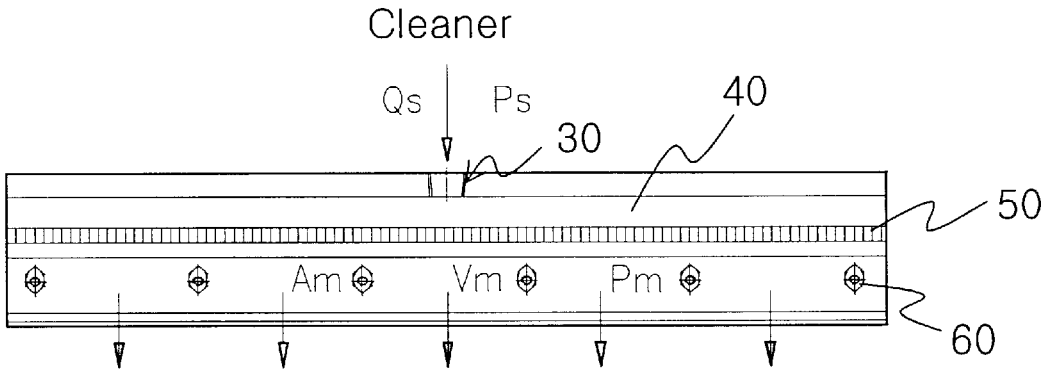
FIG. 5*a* is a drawing showing another embodiment of the high-speed shower device.
Figure 5B:
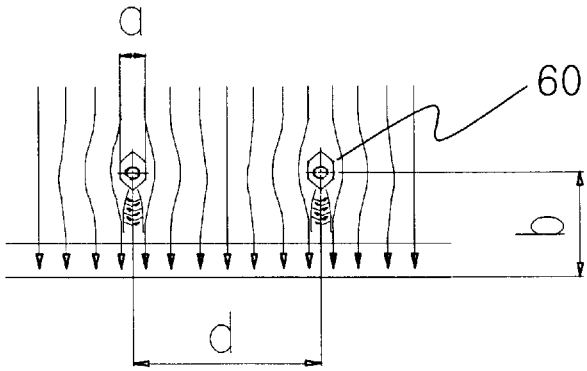
FIG. 5*b* is a partial enlarge view of FIG. 5*a.*
Figure 6:
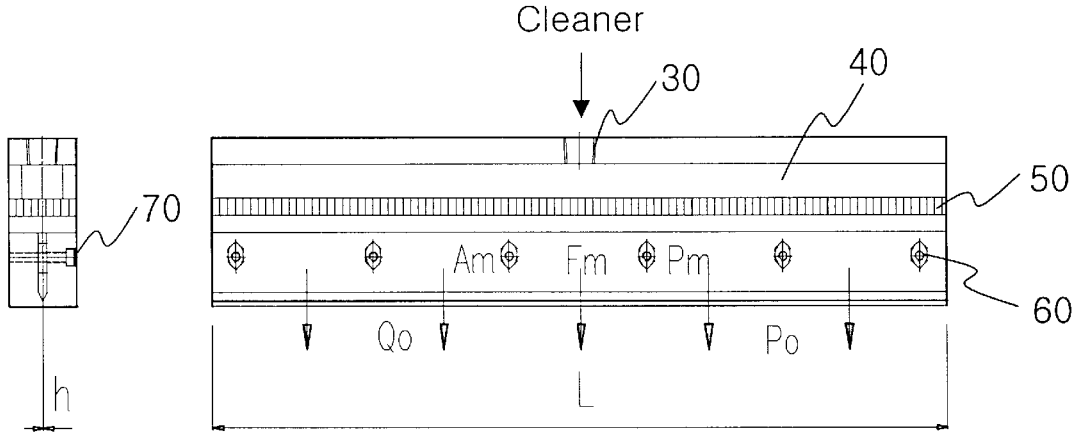
FIG. 6 is a reference view for explaining FIGS. 5*a* and 5*b.*

FIG. 5*a* is a drawing showing another embodiment of the high-speed shower device, FIG. 5*b* is a partial enlarge view of FIG. 5*a,* and FIG. 6 is a reference view for explaining FIGS. 5*a* and 5*b*.

Referring to drawings, the laminar flow generated by the perforated plate 50 is exfoliated by a connecting device 60 thereby generating a vortex. An elimination of this vortex is controlled by the size a of the connecting device 60 and a distance b between neighboring the connecting devices. To prevent the vortex, in this embodiment, the distance b is 3–5 times of the size a.

In the drawings, Pm is a press under the perforated plate 50, h is a gap between neighboring nozzles, Fm is a force operating on the gap h. In order to compensate an elastic change of a gap between neighboring nozzles, a connecting device 70 is provided.

Figure 7:
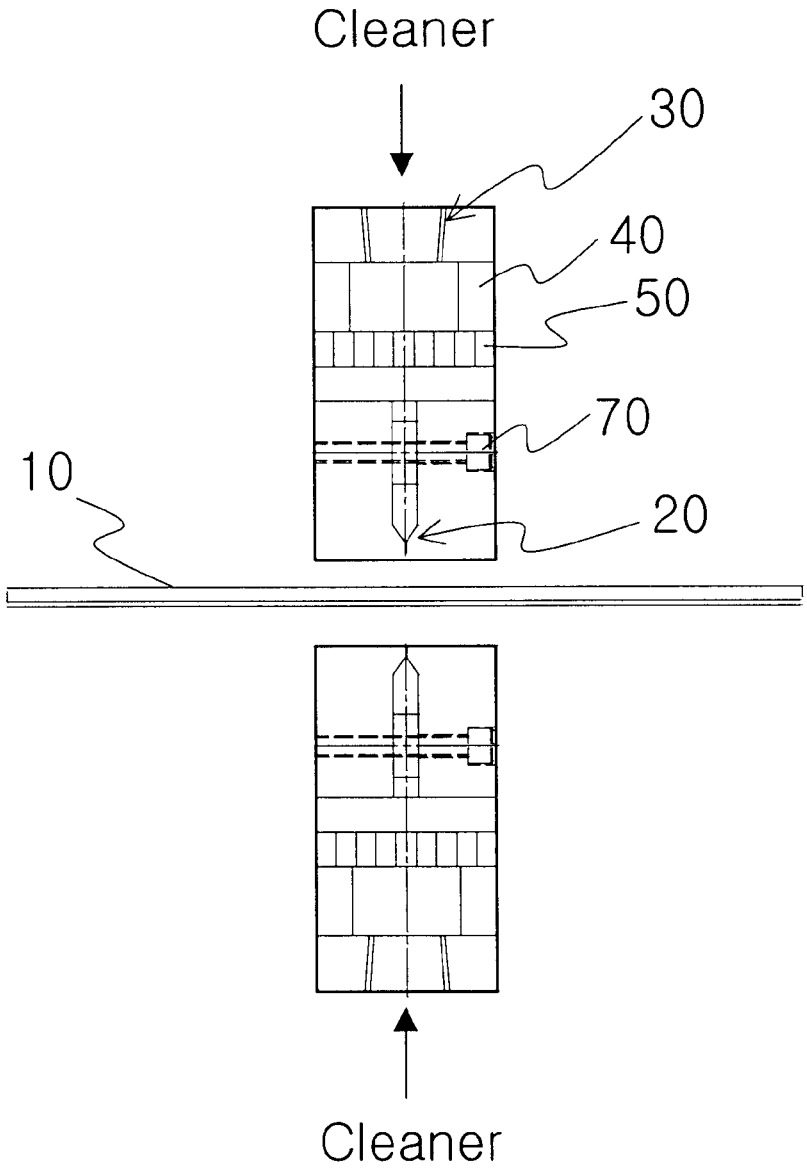
FIG. 7 is a drawing showing still another embodiment of the high-speed shower device.

FIG. 7 is a drawing showing still another embodiment of the high-speed shower device.

By this embodiment, upper and lower part of the glass substrate 10 are cleaned at the same time by a velocity energy and a collision energy.

Figure 8:
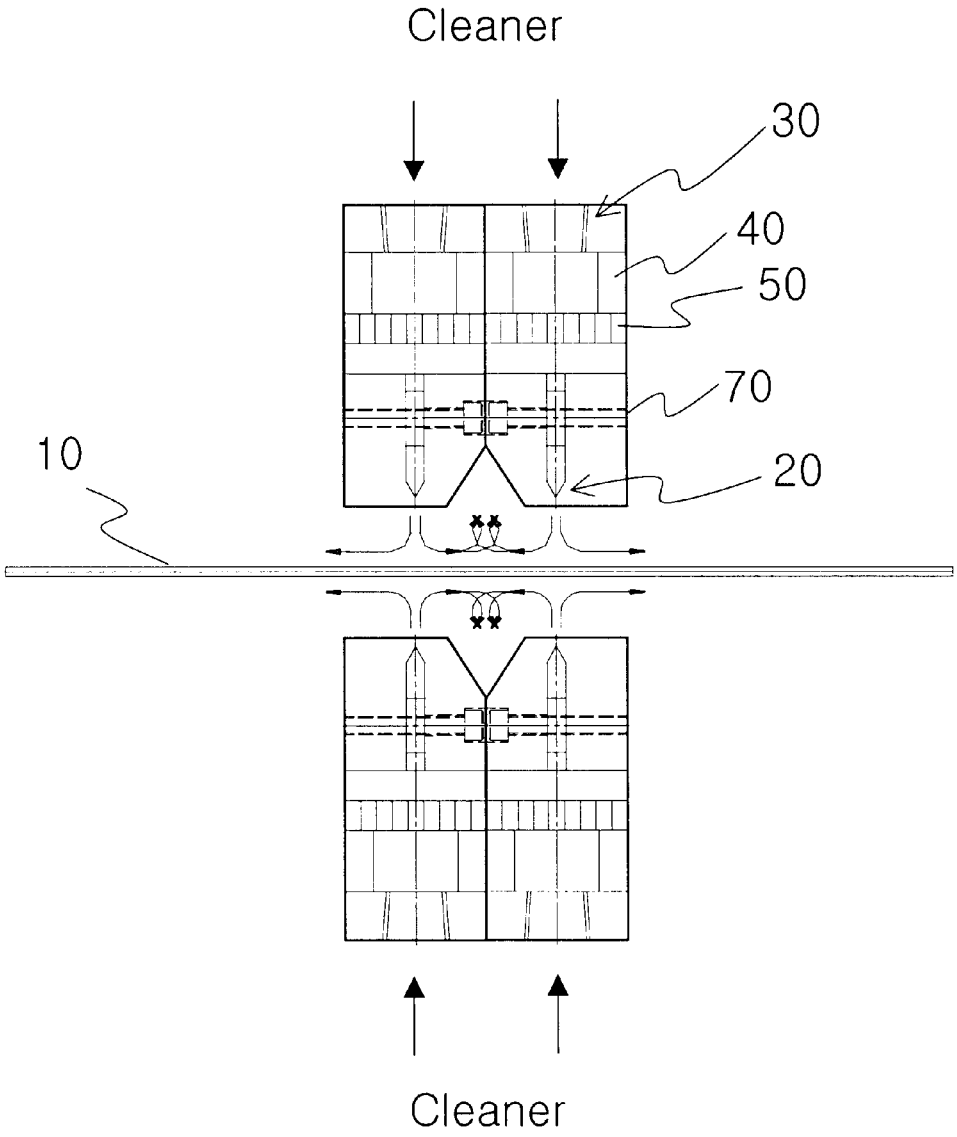
FIG. 8 is a drawing showing still another embodiment of the high-speed shower device.

FIG. 8 is a drawing showing still another embodiment of the high-speed shower device.

In this embodiment, the high-speed shower device is provided continually on a plane as well as on upper and lower side as FIG. 7.

Constitution according to FIG. 7 and FIG. 8 is based on FIG. 4 to FIG. 6, therefore description of each element is omitted.

V-Type Air Knife

Figure 9A:
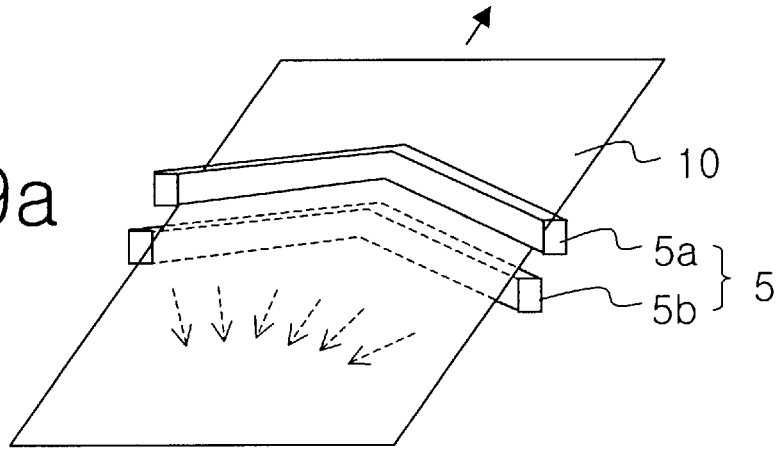
FIGS. 9*a* and 9*b* are drawings showing the V-type air knife of the multi functional cleaning module according to the present invention.
Figure 9B:
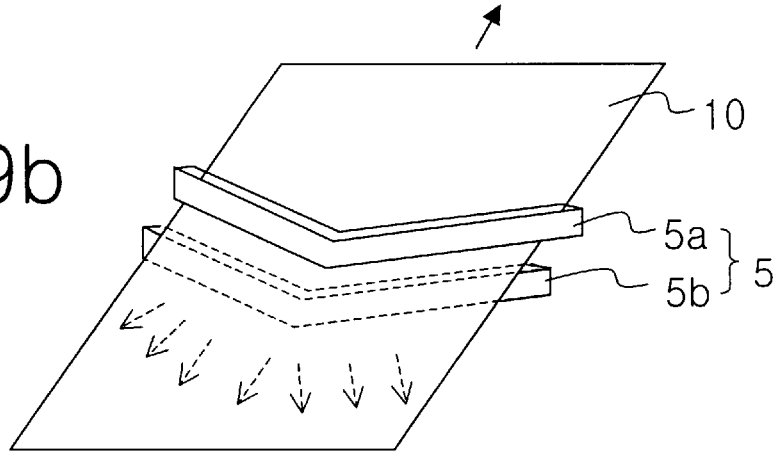

FIGS. 9*a* and 9*b* are drawings showing the V-type air knife of the multi functional cleaning module according to the present invention.

Referring to FIGS. 9*a* and 9*b,* the V-type air knife 5 according to the present invention comprises an upper and lower air knife 5*a,* 5*b,* and inflow and outflow holes (not illustrated).

In FIG. 9*a,* the cleaner is removed on a center portion of the glass substrate 10, however, in FIG. 9*b,* the cleaner is removed on side portions of the glass substrate 10.

In this embodiment, the glass substrate 10 moves in state that the V-type air knife 5 is stopped, but it is possible to move the V-type air knife 5 in state that glass substrate 10 is stopped.

Driving Part

Figure 10:
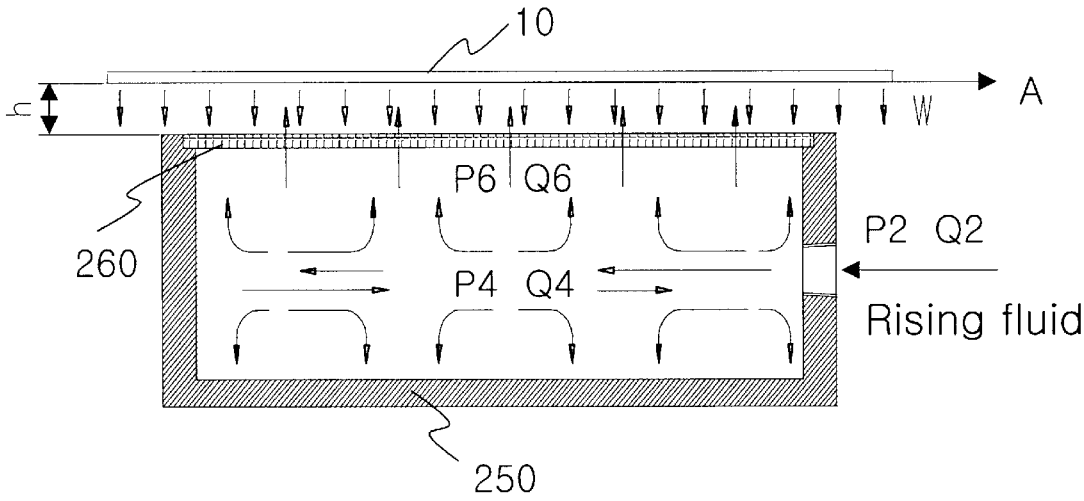
FIG. 10 is a drawing for explaining a principle of the driving part of the multi functional cleaning module according to the present invention.

FIG. 10 is a drawing for explaining a principle of the driving part of the multi functional cleaning module according to the present invention.

Referring to FIG. 10, a jet valve of the driving part comprises a water tank 250, and a perforated plate 260.

Firstly, the rising fluid of press P2 and quantity Q2 flowed into the water tank 250, at this time, the quantity Q2 is same a quantity Q4 in the water tank 250 and a press in the water tank 250 is decreased.

Secondly, if potential energies are same not considering the energy loss, a press P4 in the water tank 250 is increased rapidly due to changing of a velocity energy to a press energy based on the Bernoulli equation.

On the other hand, since diameter of the perforated plate 260 is small, the rising fluid in the water tank 250 is pressed uniformly, and then an uniform press P6 is maintains on the jet valve and under the glass substrate 10 by the perforated plate 260.

Continually, an uniform gap h is maintains between the jet valve and the glass substrate 10 by an uniform distribution tare W of the glass substrate 10 and the uniform spouting press P6 thereby not contacting the glass substrate 10 with the jet valve.

A mark A represents a running direction of the glass substrate 10.

Figure 11:
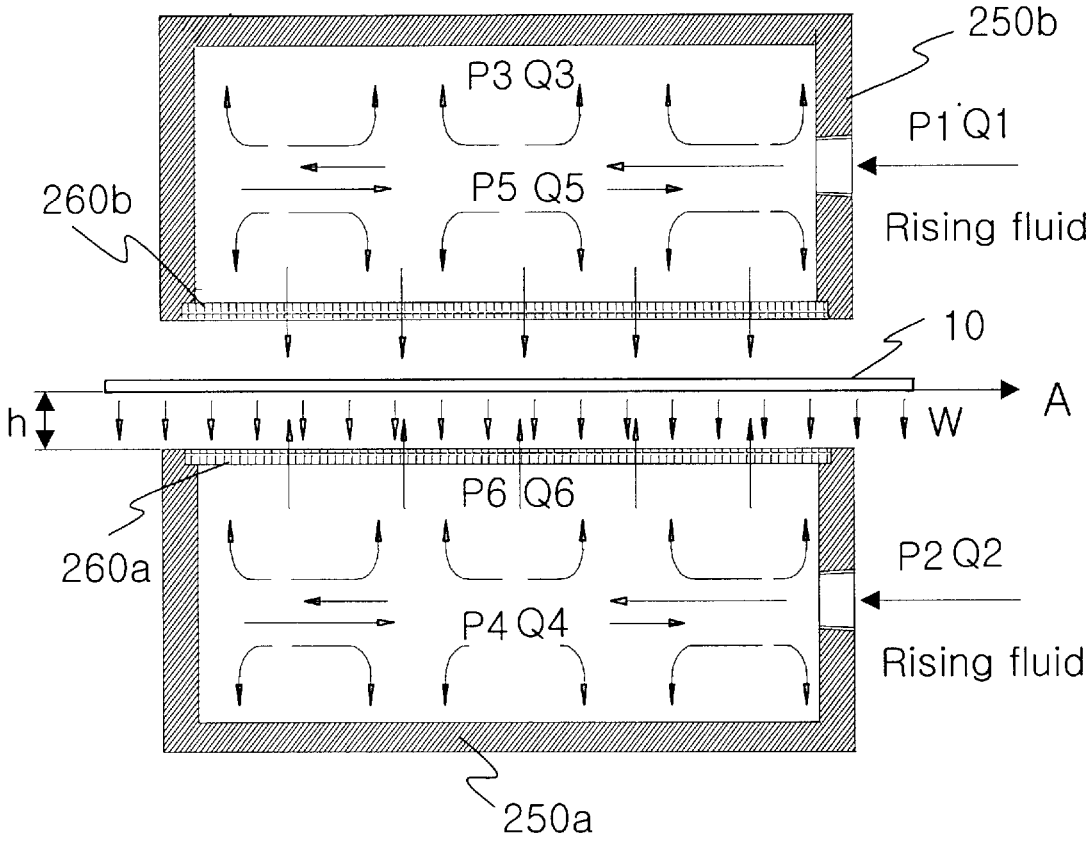
FIG. 11 is a drawing for explaining another principle of a driving part.

FIG. 11 is a drawing for explaining another principle of a driving part.

In this case, a pair of jet valves are provided upper and lower portions of the glass substrate 10 because the center of gravity may be shake in a moment by press and tare of the cleaner. Accordingly, upper and lower jet valves are provided less than 1 mm from surfaces of the glass substrate 10 thereby a press P1 by the upper jet valve and a press P2 by the lower jet valve become same.

In the drawing, marks 250*a* and 250*b* represent water tanks, and marks 260*a* and 260*b* represent perforated plates.

Figure 12A:
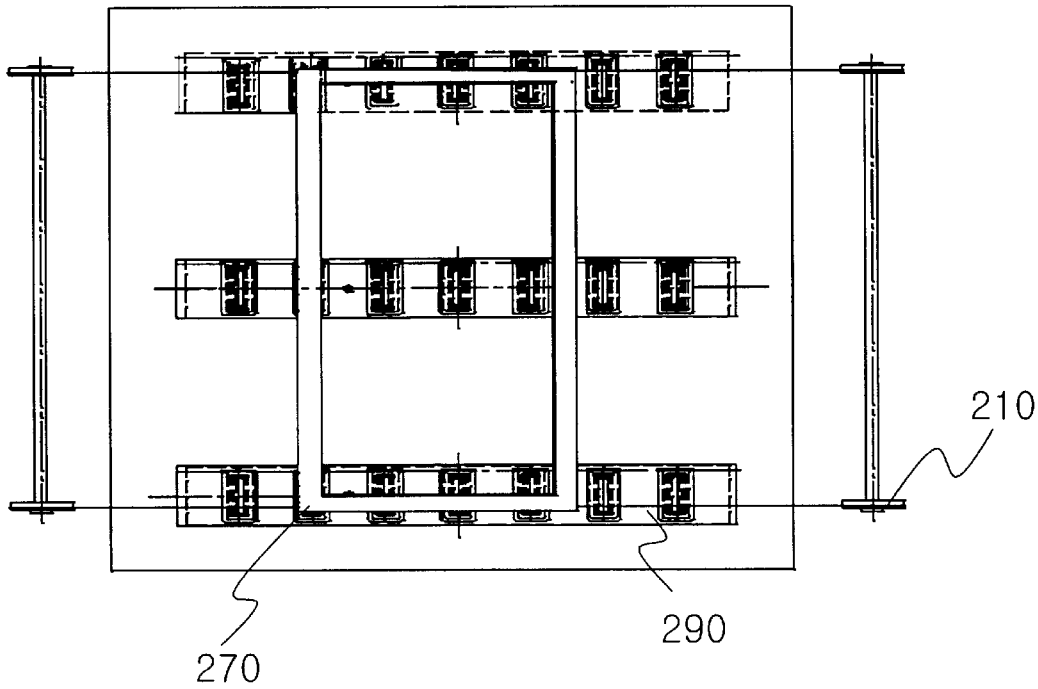
FIG. 12*a* is a plane view showing one embodiment of the driving part of the multi functional cleaning module according to the present invention.
Figure 12B:
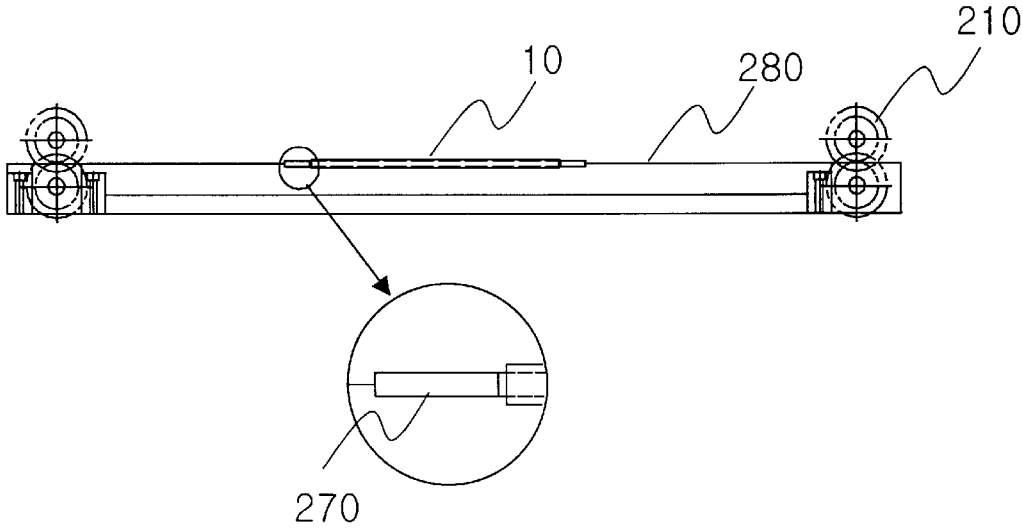
FIG. 12*b* is a side view of FIG. 12*a.*

FIG. 12*a* is a plane view showing one embodiment of the driving part of the multi functional cleaning module according to the present invention, and FIG. 12*b* is a side view of FIG. 12*a*.

Referring to FIGS. 12*a* and 12*b,* the driving part comprises a driving roller 210, a glass transporting cart 270, a transporting wire 280, and a jet valve 290.

The glass transporting cart 270 is connected to the driving roller 210 through a power transporting wire (not illustrated). The glass substrate 10 is floated by the jet valve 290 and then the glass substrate 10 is located in the glass transporting cart 270.

Figure 13A:
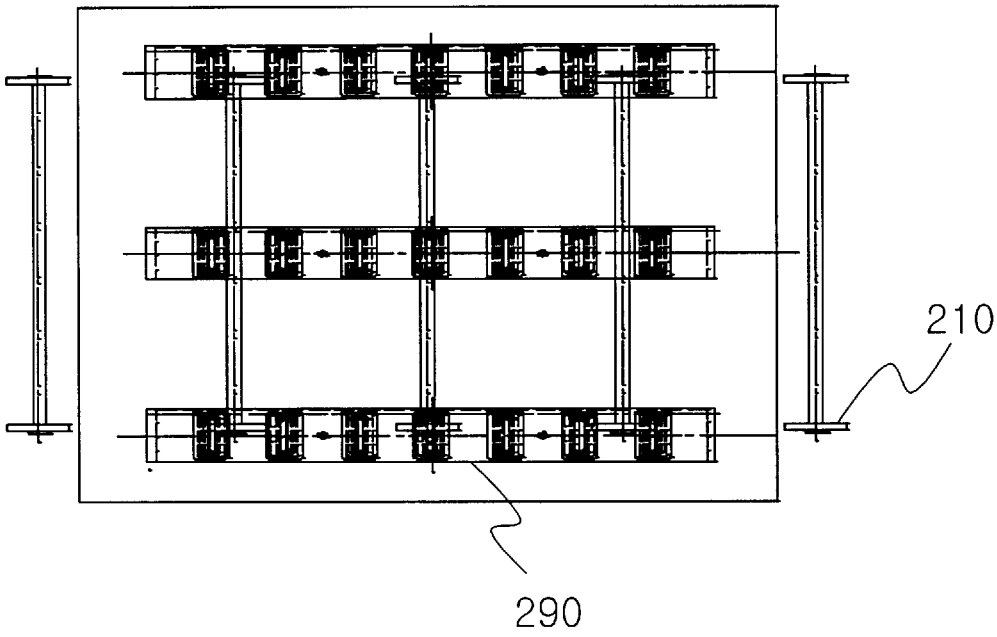
FIG. 13*a* is a plane view showing another embodiment of the driving part.
Figure 13B:
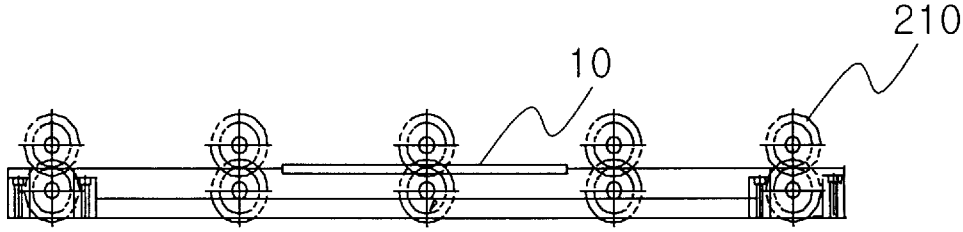
FIG. 13*b* is a side view of FIG. 13*a.*

FIG. 13*a* is a plane view showing another embodiment of the driving part, and FIG. 13*b* is a side view of FIG. 13*a*.

In this embodiment, except for the glass transporting cart 270 described in FIGS. 12*a* and 12*b,* all elements are same with the foregoing.

Figure 14:
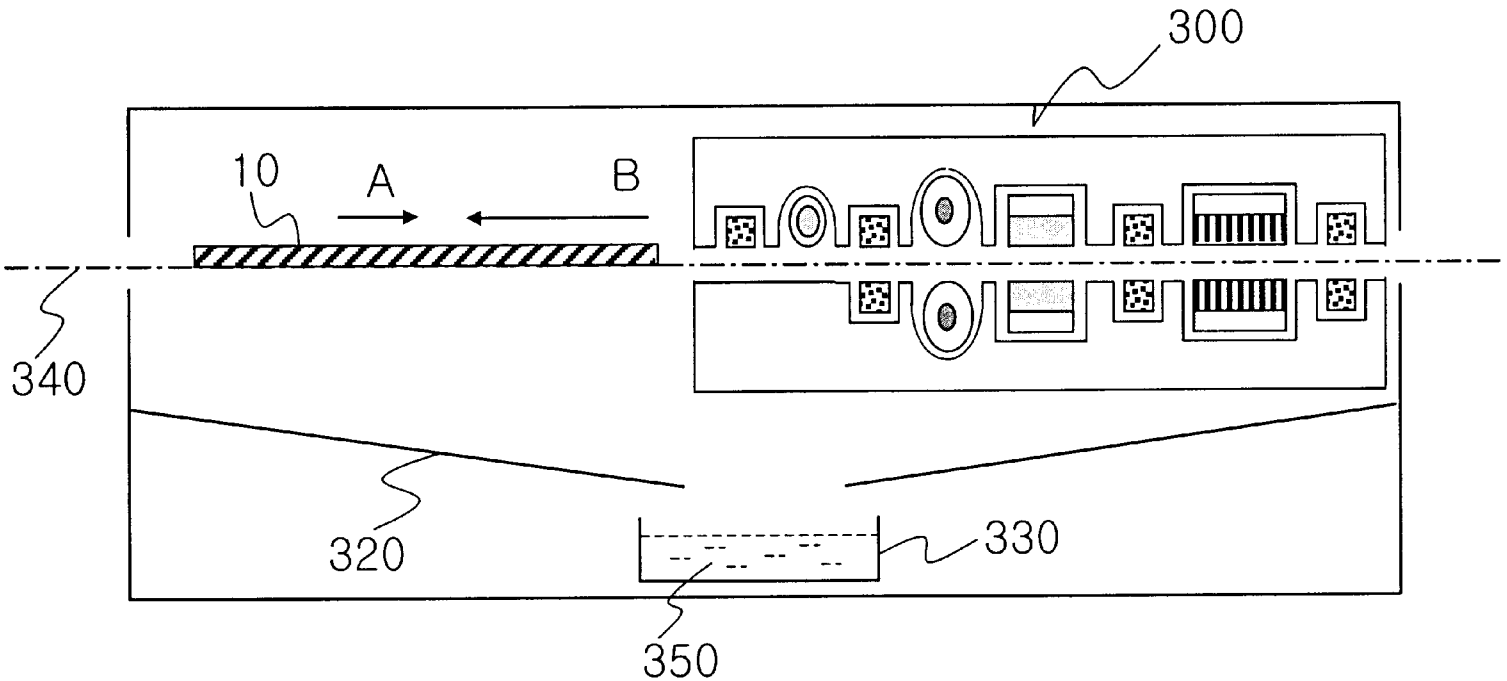
FIG. 14 is a schematic side view of the cleaning apparatus according to one embodiment of the present invention.

FIG. 14 is a schematic side view of a cleaning apparatus according to one embodiment of the present invention.

Referring to FIG. 14, the cleaning apparatus comprises a driving part 340 executing loading and unloading the glass substrate 10, a multi functional cleaning module 300 having a plurality of air curtain, an eximer ultraviolet light irradiating device, a brush, a high-speed shower device, and an air knife, where they are arranged continually on a plan and the glass substrates are inserted continually into them, a supporting plate 320 for collecting a cleaner 350 such as D.I, and a water tank 330.

In the drawing, a mark A represents a running direction of the glass substrate 10 and mark B represents a running direction of the multi functional cleaning module 300.

Figure 15:
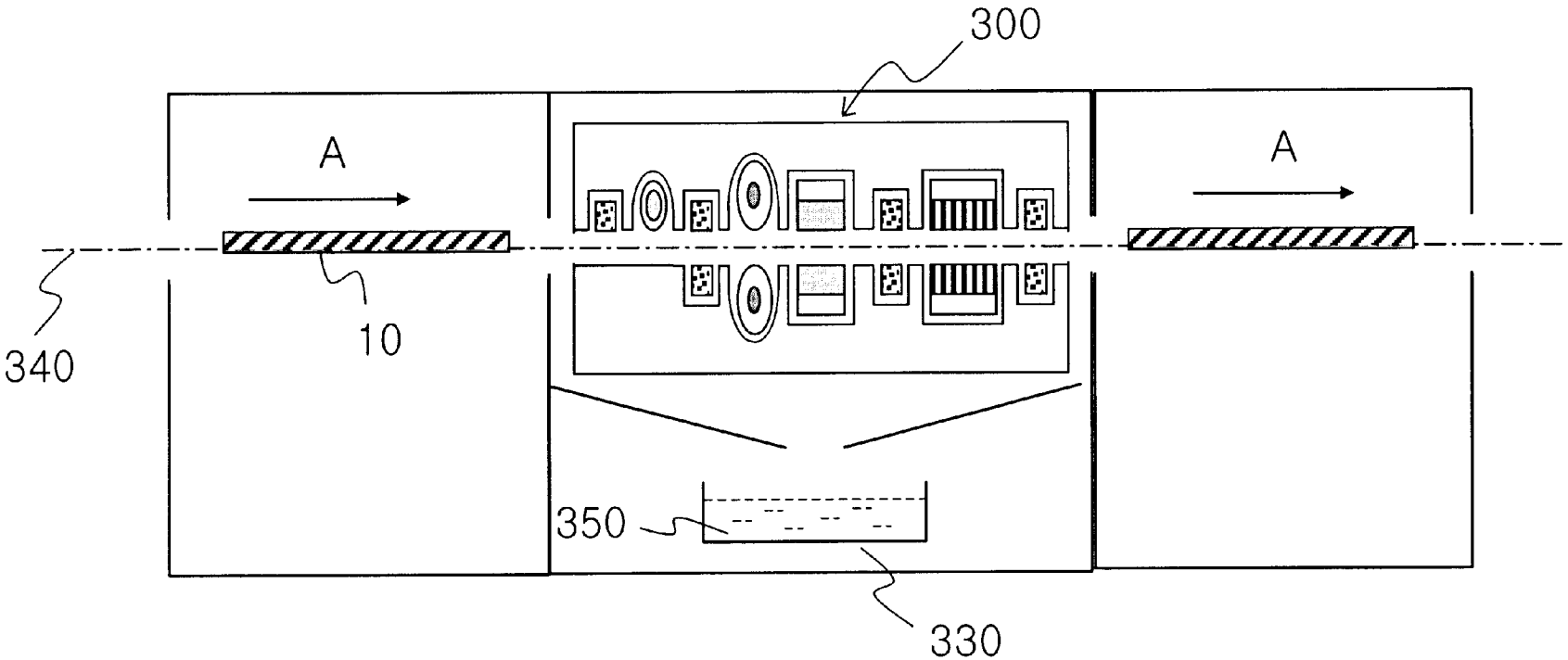
FIG. 15 is a schematic side view of the cleaning apparatus according to another embodiment of the present invention.

FIG. 15 is a schematic side view of a cleaning apparatus according to another embodiment of the present invention.

In this embodiment, except for multi functional cleaning module 300 is fixed, all elements are same with the foregoing.

According to the present invention, by using the multi functional cleaning module, which the elements are integrated thereby minimizing an installation area and operating effectively a space in FAB.

Furthermore, according to the present invention, it is possible to increase an yield of the flat panel display such as liquid crystal display device by using the multi functional cleaning module.

It is further understood by those skilled in the art that the foregoing description is a preferred embodiment of the disclosed device and that various changes and modifications may be made in the invention without departing from the spirit and scope thereof.

What is claimed is:

1. A multi functional cleaning module for a flat panel display through which at least one glass substrate travels, comprising:

a structural frame oriented substantially coplanar to a glass substrate plane of travel;

a plurality of air curtains arranged on the frame;

an excimer ultraviolet light irradiating device arranged on the frame;

a brush arranged on the frame;

a high-speed shower device arranged on the frame; and, a V-type air knife arranged on the frame.

2. The multi functional cleaning module according to claim 1, wherein the excimer ultraviolet light irradiating device comprises a lamp housing, a cylinder type quartz tube, and an ultraviolet light lamp in the cylinder type tube.

3. The multifunctional cleaning module according to claim 2, wherein the ultraviolet light lamp comprises a plurality of outer electrodes, an inner electrode, and a lamp electric source.

4. The multi functional cleaning module according to claim 2, wherein a reflective film is provided in the cylinder type quartz tube to reflect ultraviolet light generated from the ultraviolet light lamp.

5. The multi functional cleaning module according to claim 1, wherein the high-speed shower device comprises a tank in which a cleaner flows, and a perforated plate for changing the cleaner to a laminar flow and spreading the cleaner onto the surface of the glass substrate.

6. The multi functional cleaning module according to claim 5, wherein the high-speed shower device is provided on upper and lower portions of the glass substrate.

7. The multi functional cleaning module according to claim 5, wherein the high-speed shower device jets one of an etchant and a developer.

8. The multi functional cleaning module according to claim 1, wherein the V-type air knife comprises upper and lower air knives to the glass substrate, and inflow and outflow holes for air.

9. The multi functional cleaning module according to claim 1, further comprising:

at least one driving roller;

at least one glass transporting cart, which is powered by the at least one driving roller;

at least one transporting wire for transporting the glass transporting cart, wherein the at least one transporting wire is substantially coplanar with a preferred glass transporting cart path; and, at least one jet valve within the glass transporting cart, the at least one jet valve comprising a tank and a perforated plate.

10. A cleaning apparatus for a flat panel display into which glass substrates are inserted, comprising:

a driving part permitting the loading and unloading of one or more glass substrates and transporting the one or more glass substrates through the cleaning apparatus along a plane;

a multi functional cleaning module having a plurality components, including a plurality of air curtains, an excimer ultraviolet light irradiating device, a brush, a high-speed shower device for spraying a liquid onto the one or more glass substrates, and an air knife, wherein the components are arranged on a frame which is substantially coplanar to the glass substrate transport plane;

at least one supporting plate mounted under the multi functional cleaning module for collecting the liquid; and, a water tank for receiving liquid collected by the supporting plate.

* * * * *